United States Patent [19]

Cope

[11] 3,941,063

[45] Mar. 2, 1976

[54] TRUCK SIDE FRAME AND BOLSTER CONNECTION

[75] Inventor: Geoffrey Wilton Cope, Williamsville, N.Y.

[73] Assignee: Dresser Industries, Inc., Dallas, Tex.

[22] Filed: Oct. 23, 1974

[21] Appl. No.: 517,111

[52] U.S. Cl. ..... 105/203; 105/197 A
[51] Int. Cl.[2] ..... B61F 3/00
[58] Field of Search ..... 105/200, 201, 202, 203, 105/206 R, 206 A, 179, 187, 197 A

[56] References Cited

UNITED STATES PATENTS

| | | | |
|---|---|---|---|
| 1,188,812 | 6/1916 | Mulvihill | 105/203 |
| 2,061,767 | 11/1936 | Hobson | 105/203 X |
| 2,066,602 | 1/1937 | Barrows et al. | 105/197 A |
| 2,609,757 | 9/1952 | Blomberg | 105/197 A |
| 3,517,620 | 6/1970 | Weber | 105/197 A |

*Primary Examiner*—John J. Love
*Attorney, Agent, or Firm*—Raymond T. Majesko; John N. Hazelwood

[57] ABSTRACT

A freight car truck side frame-bolster connection which provides self-squaring or self-tramming forces by resilient means incorporated in bearing shoes that cooperate with the bolster ends and the side frame window opening to produce the desired results. Also, the provision of the resilient squaring force is accomplished while maintaining the ability to shim at the bolster ends for adjustment of car height, and without the need for close tolerances.

7 Claims, 3 Drawing Figures

TRUCK SIDE FRAME AND BOLSTER CONNECTION

It has been well established by experience, theoretical studies and tests that a freight truck that is held square or in tram is much less affected by "hunting" than one that can go out-of-square when subjected to the normal external forces encountered in operation.

The forces that are involved in unsquaring or parallelogramming a truck are well defined to the extent that the required resistance to prevent it can be readily determined.

In prior art trucks positive squaring has been accomplished by means of "spring planks," integral bolsters, closely fitted side frame — bolster connections or restraints such as radius rods. All of these methods are either prohibitively expensive, mechanically inadequate for the present day operating environment or undesirable from a required maintenance standpoint.

Also, the flanges of the bolster and the width of the tension member and columns of the side frames were toleranced for a working fit with the minimum practicable clearance in order to control the squareness of the assembly. The disadvantages are that tight tolerance control adds substantially to cost and the fit and squareness control is gradually lost through wear and maintenance is necessary to restore the controlling surfaces.

It is the object of the present invention to provide squaring forces in a freight truck sufficiently in excess of the creep forces tending to unsquare the truck to assure that the side frames will remain in tram during all normal operations and thereby reduce the adverse effects of "hunting."

It is a further object to utilize resilient means to produce the squaring forces so that the assembly of wheels and axles, side frames and bolsters will resiliently yield under abnormal unsquaring forces and bolsters will resiliently yield under abnormal unsquaring forces and be restored immediately the abnormal force is removed thus minimizing the stresses developed at the connections under such conditions.

A still further object is to provide adequate squaring forces at a side frame and bolster connection in a manner that will permit the use of shims at that location in order to adjust the height of the car as required by A.A.R. Interchange Rules.

An additional object is to provide positive squaring at the side frame — bolster connection without the need to manufacture the components to close tolerances and fits.

Another object is to provide the side frames with the ability to vertically articulate about the bolster end and thus equalize the wheel loading and negotiate vertical track deviations and spirals without unloading any of the wheels.

Still another object is the reduction of wear at the side frame — bolster connection by the elimination of the metal-to-metal contact at the working interface.

Other features of the invention will become apparent from the appended claim and as the ensuing detailed description and discussion proceeds in conjunction with the accompanying drawings in which:

Figure 1:
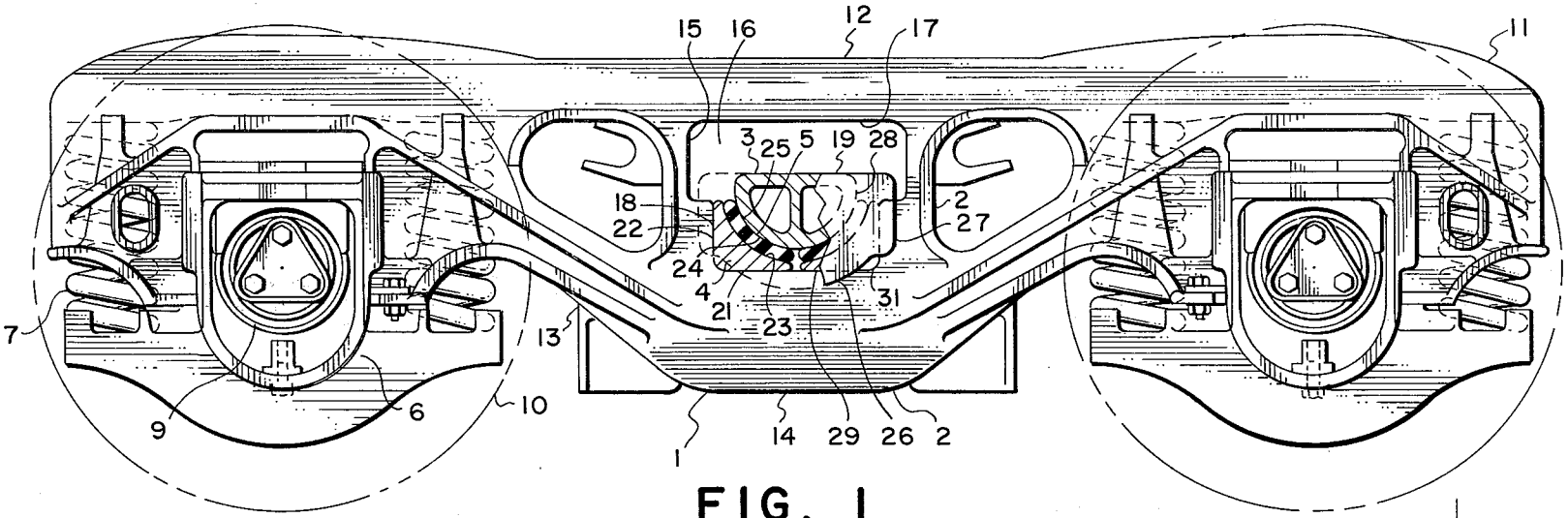
FIG. 1 is a side elevation view partly in cross section of a freight car truck illustrating a side frame bolster connection according to the present invention.

In accordance with the present invention, there is provided a freight car truck having side frames and a bolster. The side frames contain a bolster window which is formed by an upper compression member, a lower tension member and a pair of vertical columns for receiving bolster ends. The bolster ends have a convex undersurface which is supported within the window by resilient pad means conforming to its surface. The pads also conform to a concave surface on the tension member. The combination of the concave surface and the resilient pad provide a bearing for the side frame ends.

Referring now to the drawings, a railroad freight car truck 1 of the instant invention consists of side frames 2, a bolster 3, bearing blocks 4 with resilient pads 5 bonded thereon, journal boxes 6 and a multiplicity of supporting springs 7.

Each side frame 2 is of the conventional truss design and has pedestal jaws 8 arranged for accepting the journal boxes 6 and springs 7 in the manner of a conventional primary spring suspension arrangement.

The journal boxes 6 in turn journal the ends of the axles 9 and so become part of the wheelsets 10. The side frame 2 pedestal ends 11 are joined through the upper compression member 12 of the truss and through the obliquely inclined tension member 13 interconnecting a lower tension member 14 which is parallel to and located directly below the upper compression member 12. The tension member 14 and the compression member 12 are connected by a pair of columns 15 to form a bolster window 16 in the side frame 2.

The upper portion 17 of the window opening 16 is of greater width than the lower portion 18 to permit insertion of the bolster end 19 retaining lugs or flanges 26 and 27 which cooperate with the lower portion 18 of the window 16 when in the assembled position to provide an interlock against inadvertent separation.

Between the bolster end 19 and the side frame window lower portion 18 pairs of bearing blocks 4 are installed to provide a bearing for the bolster ends 19. The bearing blocks 4 are essentially triangular in section and of a length equal to the width of the tension member 14 with the lower surface 21 and vertical surface 22 flat and at right angles with one another and the third surface 23 cylindrically concave to conform to and provide bearing for the cylindrical lower surface 24 of the bolster end 19.

The concave bearing surface 23 of the blocks 20 is provided with an elastomer pad 25 secured by bonding to provide a resilient seat which will conform to the as-cast shape of the bolster end lower surface 24, when supporting the load carried through the bolster 3 from the car body and lading (not shown).

The bolster 3 is of conventional integrally cast design in all respects with the exception of the ends 19 which are, as described above with a cylindrical lower surface 24 with flanges 26 and 27 outstanding from the side walls 28, respectively and bottom wall 29 which in assembled relationship overlap the lower portion of the columns 15 and the tension member 14, respectively.

In the assembled and working relationship, the bolster 3 distributes the car body and lading weight through the center plate 30 and the bolster ends 19 and the bearing blocks 4 to the side frame 1 and through the side frame to the axle journals and the wheels. The effect of the bolster end 19 load on the elastomer pads 25 of the bearing blocks 4 is complex in that the elastomer 25 is strained in compression in the lower sector and in shear in the upper sector with a varying combination of both in between.

In addition, the elastomer which is essentially incompressible and somewhat hydraulic in nature is caused to flow from the lower sectors toward the upper sectors because of the load differential and thereby tends to equalize the unit pressure over the major portion of the contact area. In this manner the vertical load is utilized to provide lateral force to accomplish the squaring function. The resultant force on each bearing block is between 45° and 60° from the horizontal depending upon the elastomer used and radius of the bolster lower surface 24 and the bearing block surface 23.

In the lateral direction axial movement of the bolster 3 is controlled by the shear resistance of the elastomer pad 25 to the extent of the friction between the bearing blocks and the side frame and limited by the flanges 26 and 27.

Further control of the lateral movement of the bolster 3 axially relative to the side frame 2 can be obtained by interlocking the bearing blocks 4 to the side frame tension member 14 and/or the columns 15 to prevent relative lateral movement between these two components.

To assure that the truck remains assembled in mishaps, such as derailments, a block or stop 28 may be attached to the top wall 29 of the bolster end 19 to prevent the flanges or lugs 26 and 27 from becoming disengaged with the side frame members 14 and 15.

During its service, a freight car sustains wear at various points and the coupler height from the rail is reduced to the extent that it must be adjusted upward in order to comply with A.A.R. requirements.

The accepted practice is to shim at the truck bolster usually below the springs in a secondary suspension truck.

Shimming below the springs in a primary suspension truck, however, would require sixteen shims per car and is in other ways not a practical method. Shimming below the bolster between the bolster end and the side frame is decidedly the preferred method.

The construction of the instant invention bolster end connection provides for the placement of simple rectangular shims 31 between the bearing blocks 4 and the top of the tension member 14 without changing the squaring function of the arrangement.

Figure 3:
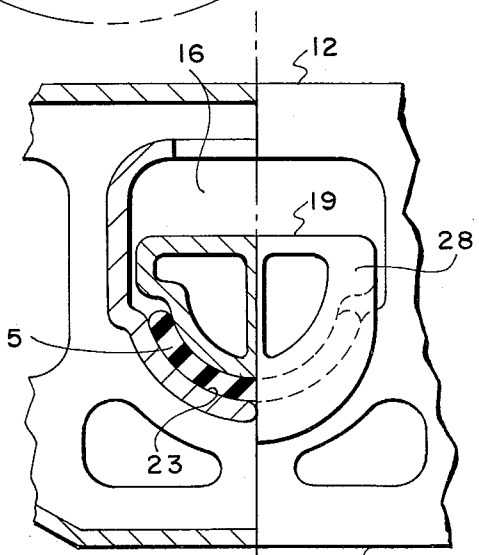
Figure 2:
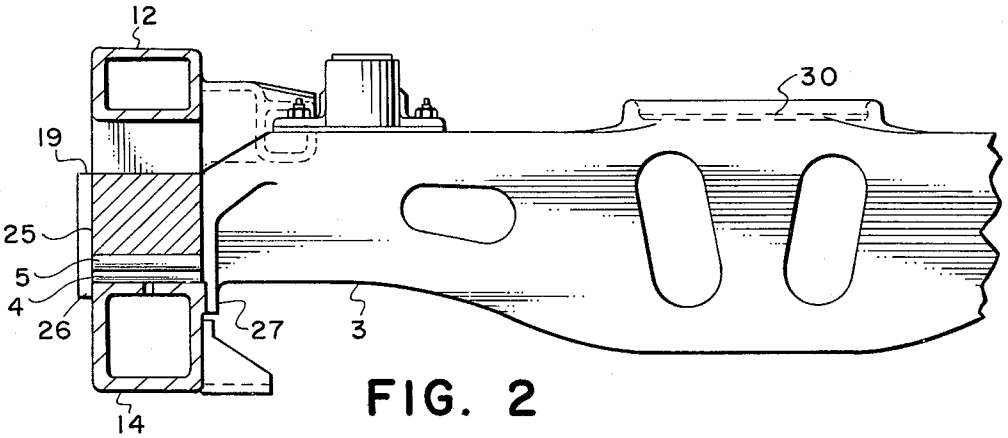
FIG. 2 is a front elevation view partly in cross section of the freight car truck of FIG. 1; and, FIG. 3 is a side elevation partly in cross section of a portion of a side frame illustrating another embodiment of the present invention.

Referring to FIG. 3, an embodiment is shown wherein the concave surface 23 is formed integrally with the tension member 14. The bolster end 19 lower surface 24 conforms to the contour of the resilient pad 5 and concave surface 23.

This arrangement provides positive squaring action while permitting relative rotary action. The design is such that the squaring action is provided with as-cast parts and with normal casting tolerances. The construction also allows good distribution of metal in the side frame tension member, especially at the corners.

A further advantage is the isolation of high frequency vibration transmission by the resilient pad which can be of a fairly low Durometer hardness because of its large area.

It is intended that the foregoing description and drawings be construed as illustrative and not in limitation of the invention.

Having thus described the invention in detail and with sufficient particularity as to enable those skilled in the art to practice it, what is desired to have protected by Letters Patent is set forth in the following claims.

1. In a railroad freight car truck having side frames interfacing with a bolster, said side frames having a bolster window formed by an upper compression member, a lower tension member and a pair of vertical columns for receiving bolster ends, the improvement comprising the bolster ends having a convex undersurface supported within the window by resilient pad means conforming to its surface and a concave surface on the tension member to provide positive squaring at the side frame — bolster interface.

2. Railroad freight car truck of claim 1 in which the concave surface is an integral part of the tension member.

3. Railroad freight car truck of claim 1 in which the concave surface is a non-integral part of the tension member.

4. Railroad freight car truck of claim 3 in which the concave surface is formed by a pair of bearing blocks which securely fit on conforming surfaces of the tension member.

5. Railroad freight car truck of claim 4 in which the bearing bolcks are essentially triangular in cross section and of a length substantially equal to the width of the tension member and having a flat lower surface and vertical surface at right angles to one another and a joining concave surface which conforms to the convex undersurface of the bolster ends and resilient pad means.

6. Railroad freight car truck of claim 1 in which the resilient pad means is bonded to the concave surface.

7. Railroad freight car truck of claim 4 in which the bearing blocks are interlocked with the side frame tension member.

* * * * *